United States Patent [19]

Sinn et al.

[11] 3,987,961

[45] Oct. 26, 1976

[54] CENTRIFUGE BAG FOR TREATMENT OF BIOLOGICAL LIQUIDS

[75] Inventors: Hartmut Sinn; Hans Stallmann, both of Osterode, Germany

[73] Assignee: Heraeus-Christ GmbH, Osterode, Germany

[22] Filed: Jan. 23, 1975

[21] Appl. No.: 543,490

[30] Foreign Application Priority Data

| | | |
|---|---|---|
| Jan. 29, 1974 | Germany | 2404036 |
| Feb. 21, 1974 | Germany | 2408206 |
| Aug. 31, 1974 | Germany | 2441824 |

[52] U.S. Cl. ..... 233/27; 233/14 R; 233/19 R; 128/214 D

[51] Int. Cl.[2] ..... B04B 15/06

[58] Field of Search ..... 233/1 R, 1 A, 1 D, 3, 233/14 R, 14 A, 19 R, 19 A, 26, 27, 28; 128/214 D; 150/1; 210/DIG. 23

[56] References Cited

UNITED STATES PATENTS

| | | | |
|---|---|---|---|
| 3,211,368 | 10/1965 | Shanley | 233/26 X |
| 3,244,363 | 4/1966 | Hein | 233/26 X |
| 3,297,244 | 1/1967 | Hein | 233/27 |
| 3,326,458 | 6/1967 | Meryman et al. | 233/26 X |
| 3,545,671 | 12/1970 | Ross | 233/26 |
| 3,679,128 | 7/1972 | Unger | 233/27 X |
| 3,724,747 | 4/1973 | Unger | 233/14 R |
| 3,856,470 | 1/1974 | Cullis | 233/26 X |

*Primary Examiner*—George H. Krizmanich
*Attorney, Agent, or Firm*—Flynn & Frishauf

[57] ABSTRACT

The centrifuge rotor is formed with a central chamber and two peripheral annular chambers concentric therewith; an annular bag including ring-shaped compartments, made of flexible material, and with communicating ducts are placed into the three chambers, the central chamber additionally being big enough to accommodate a holder for treatment liquid and for the reception of treated biological fluid, after centrifuging and treatment; valves, which may be centrifugally or otherwise operated, control flow between the central bag compartment in the central chamber of treatment liquid to the intermediate bag compartment in the intermediate chamber, and flow from the intermediate compartment of used treatment fluid to the outer peripheral compartment. A dimensionally stable, bulged, disk-shaped body is located in the compartments to assure that the bag retains its shape.

6 Claims, 3 Drawing Figures

CENTRIFUGE BAG FOR TREATMENT OF BIOLOGICAL LIQUIDS

The present invention relates to a centrifuge to treat biological liquids, such as blood, in a holder placed in the centrifuge rotor, and more particularly to such an arrangement in which the holder is a bag structure of flexible, foldable material having at least three serially arranged compartments for treatment liquid, the biological liquid, and waste, or used treatment liquid, with communicating ducts therebetween.

Various apparatus to wash blood have been proposed. Some such arrangements use peristaltic pumps which directly act on a flexible blood bag (see, for example, U.S. Pat. No. 3,351,432). Other apparatus utilize peristaltic pumps in which communicating ducts between a blood bag and a container or bag of washing liquid are compressed (see U.S. Pat. No. 3,452,924), or to systems in which the liquid is pumped by a pump which is speed-dependent (see U.S. Pat. No. 3,684,160). It has already been proposed to construct a blood bag in ring shape (see U.S. Pat. No. 3,708,110) and to insert such a ring-shaped blood bag in a rotor of a centrifuge (see U.S. Pat. No. 3,679,128).

It has previously been proposed to hydraulically control the contents of a flexible blood bag located in the rotor of a centrifuge that the washing cycle can proceed automatically (see U.S. Pat. No. 3,737,096). In all these arrangements, the supply containers and the additional apparatus are located outside of the rotor.

It is an object of the present invention to simplify a centrifuge construction in which the requirement on apparatus is highly reduced, and so that all the additional apparatus can be located in the housing of a common, commercially available laboratory centrifuge, and to provide a method and apparatus in which the process for washing blood can be simplified, with a reduction in the number of steps required.

SUBJECT MATTER OF THE PRESENT INVENTION

Briefly, the rotor of the centrifuge is so constructed that it can receive a container or bag made of flexible, foldable material which has a plurality of compartments or chambers therein; one of the compartments is adapted to hold treatment liquid, such as washing liquid; the next compartment — looked at radially from the center of rotatioon of the centrifuge — is adapted to hold blood or such other biological liquid which is to be treated; the outermost compartment or chamber is adapted to hold the waste treatment liquid, that is, the treatment liquid after the treatment has been carried out, for example, the waste liquid after the blood has been washed. These chambers or compartments are preferably constructed in ring-shape, such as a plurality of nesting doughnuts, and are connected by connecting ducts with valves therein which permit closure of the ducts. The container or bag having these compartments or chambers therein is located in corresponding chambers formed in the rotor. Preferably, the cover of the rotor simultaneously forms a central holder for a fixed vessel or bottle in which the washing or treatment liquid is retained. The rotor is, additionally, centrally thereof formed with a chamber which is large enough to hold the bag from which the biological liquid is introduced into the container, and the bag in which the washed liquid is returned — or at least one of them; these bags can be connected to the container located in the chamber of the centrifuge by suitable connecting ducts, tubes, or the like.

The present invention permits the construction of a completely closed, and hence completely sterile system to treat biological liquids, particularly to wash blood. Absolute sterility is possible thereby. The use of customary infusion bottles and multiple supply and receiving bags extends the utility of the cetrifuge in accordance with the present invention, and increases its capability of being serviced and operated by laboratory personnel.

The hydraulic supply for treatment liquid, and the like, is located outside of the rotor, in a bottle located centrally thereof, for example. Thus, the entire assembly of rotor and hydraulic supply of treatment liquid can be located within the housing of a laboratory centrifuge of customary size and construction. The biological liquid to be treated, however, can be located in containers or bags of different shape and size within the centrifuging rotor. Bags made of flexible plastic material are particularly preferrcd; these bags may be unitary, or an assembly of various, preferably ring-shaped units communicating with each other by tubes or ducts or the like, and fitting into matching chambers or recesses in the rotor. Shims, or inserts to match the shape of the inside of the rotor to the shape of the bags or containers to be inserted therein can readily be placed in the rotor, thus providing for a high degree of versatility in the use and equipment usage when proceeding in accordance with the present invention.

The invention will be described by way of example with reference to the accompanying drawings, wherein.

Figure 1:
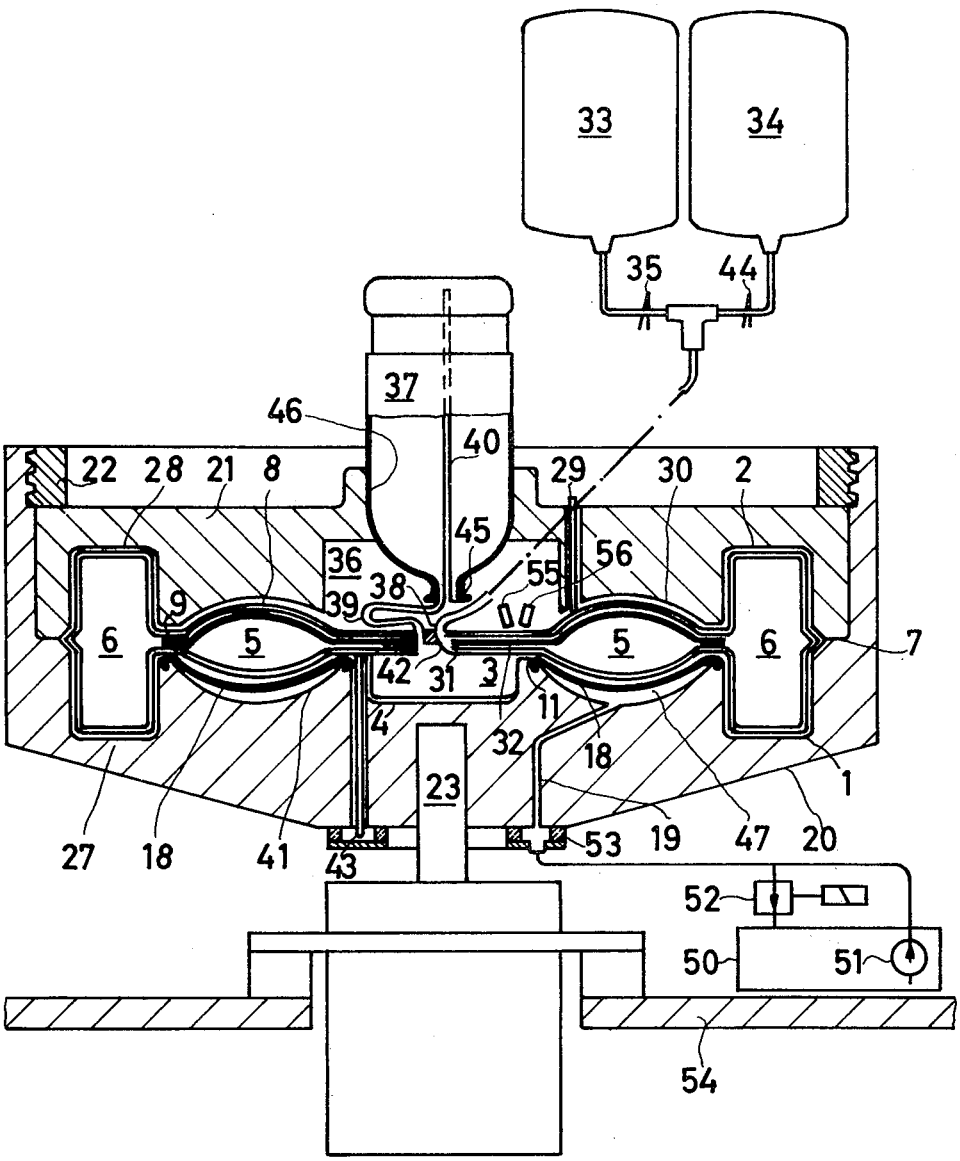
FIG. 1 is a highly schematic, longitudinal sectional view through the rotor of a centrifuge.

The rotor 20 of the centrifuge is closed by a cover 21, secured by means of a nut 22. The rotor, when closed, provides a plurality of chambers in which a flexible container or bag B is inserted. The rotor can then be placed on a shaft stub 23, which is coupled to a drive motor M, secured to a base 54.

Figure 2:
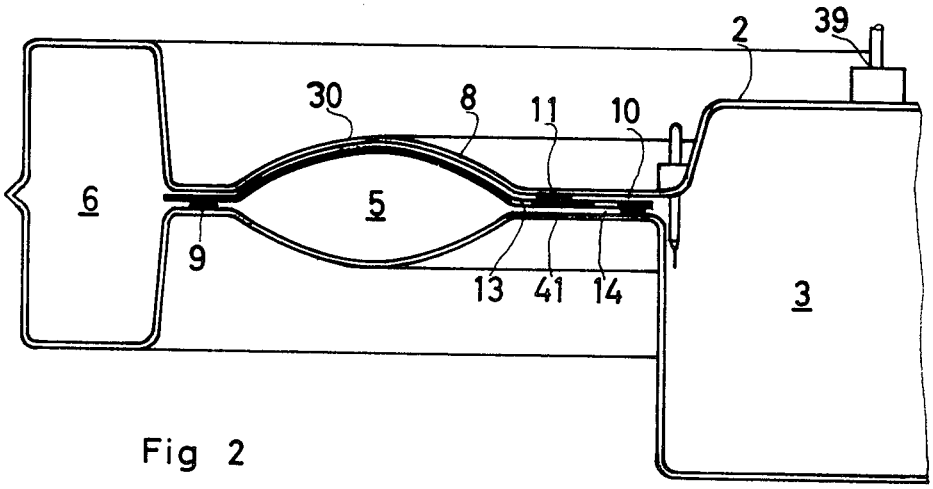
FIG. 2 is a highly enlarged and schematic detail view showing a portion of the blood bag, and a stiffening insert therefore.
Figure 3:
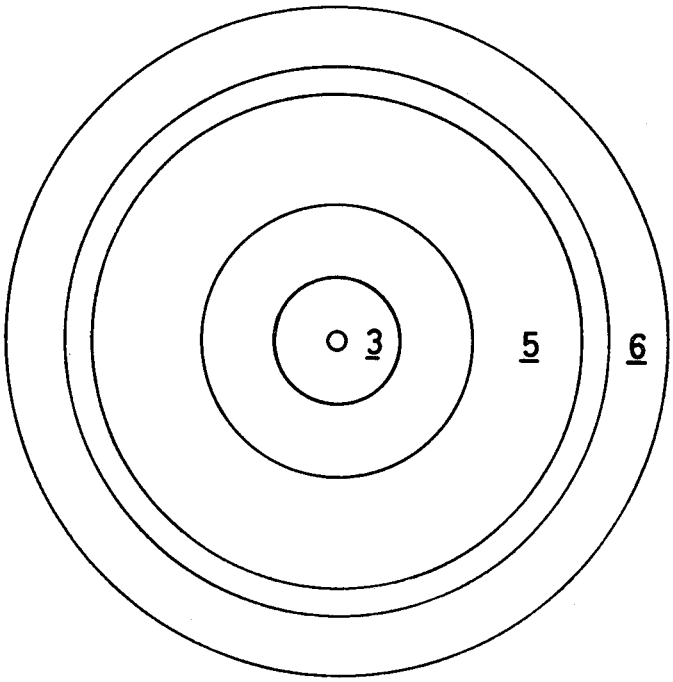
FIG. 3 is a top view of the blood bag of FIG. 2.

The container B itself is constructed of a pair of plastic films or foils 1, 2 each consisting of flexible, foldable material, to form at least three compartments for, respectively, the treatment liquid, the biological liquid, and waste. Any one compartment can communicate with an adjacent compartment over ducts which can be closed by suitable valves. The central compartment 3 is adapted to receive the treatment liquid. Concentrically surrounding compartment 3 of bag B is a ring-shaped compartment 5 into which the biological liquid can be introduced. Radially spaced from compartment 5 is the outer compartment 6 which, likewise, is ring-shaped., The plastic film or foil for the compartment is flexible and has such thickness that the walls can be folded against each other, or folded together. The lower foil or film 1 of the container is secured to the upper film or foil 2 at the outer circumferential edge, by a plastic weld 7 (see also FIG. 2). The container B need not be in the shape of a central, cylindrical container with two concentric doughnut-shaped containers surrounding the same; it may consist of a pair of oppositely arranged containers, spaced radially from each other. The central compartment 3 for the treatment liquid, typically blood-washing liquid is connected to a ring-shaped central compartment 5 which surround the central compartment 3. Two compartments 5 in communication with each other may be used, or a single compartment of circular outline (in plan view); the inner connection of compartment 3 to the compartments 5 differs at the right and left side, however, as will appear. The compartments 5 are to accept the biological liquid, typically blood to be washed. The outer compartment 6 is concentric to compartment 5 (and may be ring-shaped, or two separate elements communicating with compartment 5). The compartment 6 is adapted to receive the waste which results upon treatment of the biological liquid, for example the waste arising upon washing of blood. A shape-retaining, or forming element 8 (FIGS. 1, 2) is located within the bag B, essentially in compartment 5. Body 8 is secured to the inner walls of the bag B, and particularly where the walls merge together to form the various chambers or compartments. Body 8 preferably is made of an inert plastic material, and is secured at connecting welds 9, 10, 11 (FIG. 2) alternately to the lower foil 1 of the bag and the upper foil 2 of the bag. The body 8 is so located in the space within the bag B that it has a slight distance to the upper foil 2. The space between the upper foil 2 and the body 8 may be thought of as a duct, or to form a plurality of ducts which can be closed. These ducts can be closed by deformation of the body, or the fitting foil, by pressing thereagainst by means of pressing elements, not shown in FIG. 2. The number and shape of the ducts, as well as the selection of the suitable valves will depend on the use to which the centrifuge and the bags therein are to be put. The body 8 is generally in form of a dish, or plate, and has an external diameter which extends just about to the internal diameter of the compartment 6 (see FIG. 2). The ducts may be preformed in the body 8 upon manufacture thereof, or may otherwise be pre-formed in the foils by forming corrugations. The body 8 must, of course, be introduced into the bag before the foils 1, 2 are secured together at the weld 7. The body 8 is formed with perforations 13, 14, located, respectively, between welds 9 and 11 and welds 10 and 11, as is clearly apparent in FIG. 2. FIG. 2 also clearly shows that the body 8 is secured to the lower foil 1 at the outermost welds 9, 10, and is secured to the upper foil 2 at weld 11.

The three-compartment (looked at hydraulically) container or bag B is inserted in the rotor 20. Rotor 20, either as a unitary element, or by means of insert, is formed with suitable chambers, as seen in FIG. 1, to receive the bag B. The lower portion of the central chambers receiving the compartments 5 of the bag B have a membrane 18 located therein which is connectable over a duct 19 (right side of FIG. 1) to a source of hydraulic pressure. Upon placing hydraulic pressure in the space beneath the membrane 18, compartments 5 of bag B in the chamber formed in the rotor is compressed to effect hydraulic flow. The hydraulic unit providing hydraulic pressure through duct 19 is preferably located outside of the rotor. It can be located, preferably, within the housing of the centrifuge as a whole, and is connected by a liquid-tight connection to the rotor, A closed compressed fluid supply is provided which permits supplying the space beneath membrane 18 with compressed fluid, or to remove the compressed fluid, respectively.

A valve pin 43 is also provided to close a duct 41 formed between the lower foil 1 of bag B and body 8. A valve pin 29, at the upper right side of the rotor (FIG. 1) is provided and adapted to press against the upper foil 2 of the bag B in the region of compartment 5 to close a duct 30 formed between the body 8 and the foil 2. The hydraulic pressure supply system comprises a pump unit 50 having a pump 51 and a magnetically controlled valve 52. Pump 51 and valve 52 are connected to duct 19 by means of a rotary connection having a slip seal 53 made, for example, of coper, and connecting to duct 19 which terminates in the space beneath membrane 18. The pump assembly 50 is secured to base 54 in suitable manner (not shown), and stationary. The housing space 54 of the centrifuge encloses rotor 20 and all rotating elements, as well known. Compressed fluid also acts on the valve element 43 so that, when compressed fluid is supplied to duct 19, the duct 41 beneath element 43 also closes, preventing back-flow of fluid from compartment 5 into compartment 3.

The cover 21 of the rotor is formed with a central opening 46 which is shaped to fit the reduced or neck end of an infusion bottle 37. The neck 45 of the infusion bottle is closed by means of a stopper, through which an outlet connection 39, as well as an inlet tube 40 can pass. Connection 39 is preferably a flexible tube, and connects the outlet of the bottle 37 to the central compartment 3 of the container B, so that liquid within the bottle 37 can flow into compartment 3. For washing of blood, the infusion bottle 37 will retain an isotonic salt solution. Such infusion bottles are made in accordance with standard sizes (see, for example, size standard DIN 58363) and, when combined with suitable accessories, such as other filters and stoppers or containers, as well as with a valve 38, permit removal of contents under sterile conditions. The various valves and accessories being well known in commercial articles are not shown, only the valve 38. Sterile removal of contents may be effected, for example, by terminating a tube in a large hypodermic needle which penetrates a membrane in the container from which liquid is to be removed, simultaneously functioning as a valve. The needle, as well as the membrane, are protected from contamination by suitable caps, or the like, for example plastic films or plastic caps which are removed only immediately preceding use and connection of the bottle to the connecting container.

The central compartment 3 of the bag B, as well as the two ring-shaped outer compartments 5, 6, are introduced as a unit (or assembled into a sterile unit) as such in the rotor 20. For purposes of illustration, the use of the centrifuge will be explained in connection with the washing of blood. Prior to initiation of the process, the entire foil container B is evacuated. As a result, the thin, flexible foils 1, 2 will adhere closely to each other, or on the profiled dish or body 8, respectively.

Two multiple bags 33, 34 are connected to the central compartment 3 of container B as previously described (by penetration of a membrane, for example). Bag 33 contains the liquid to be washed — typically blood. Bag 34 is provided to receive the treated biological liquid, in the example the washed blood. The connection between the bag 34 and the container 3 is initially inhibited by the tube clamp 44. After clamp 35 is removed, the contents of bag 33 can flow into the compartment 5 of the container B, filling the container B approximately to half its capacity. When the bag 33 is empty, the connecting tube is pinched or clamped off by clamp 35. If desired, it can be welded shut by plastic welding, and bag 33 removed by cutting it off at the connecting tube. Alternatively, however, bag 33 after having been pinched off is stored together with bag 34 in the central chamber 36 formed in the rotor. Chamber 36 is of sufficient size to receive at least one, and preferably both of the bags 33, 34 to remain in the chamber 36 during the entire washing process. Chamber 36 may also be formed as an enlargement in the opening 46 in the cover 21, and then forms sufficient space to receive the multiple bags 33, 34 by placing them above the central compartment 3 of the container B in the central region of the rotor.

Initially, valve 31 for the biological liquid to be washed is connected with compartment 5 over duct 32. Duct 30 at the upper side of the profiled body 8 within the bag B, and which leads from compartment 5 to the outer compartment 6 is closed by means of the valve pin 29. Valve pin 29 bears on the upper surface of the upper foil 2. Pin 29 is preferably operated by centrifugal force upon rotation of the rotor.

Infusion bottle 37 is connected by duct 39 and valve 38 to the central compartment 3 of the container B. The wider tube 40 — provided with a filter — permits air from chamber 36 to enter the interior of bottle 37 and thus permits a portion of the treatment or washing liquid within bottle 37 to flow out. The quantity flowing out depends on the capacity of the central compartment 3 of bag B. This capacity is, preferably, only about half the capacity of compartment 5.

The centrifuge is then started and accelerated to a speed which is sufficiently high so that the washing or treatment liquid within bottle 37, rotating in the centrifuge, will rise at the outer walls thereof until the outlet connection in the neck 45 of the bottle becomes exposed.

As rotor 20 accelerates and rotates, centrifugal force will act on the contents of the washing liquid within the central compartment 3 to flow into the compartment 5 and to fill this compartment to the extent that the chambers in the rotor 20 and the cover therefor permit. The treatment liquid previously within container 3 thus is mixed with the liquid to be treated in compartment 5; in the example, the washing liquid is mixed with red blood corpuscles in compartment 5. This mixture, and washing, is additionally assisted by intermittent braking and accelerating of the rotor. Upon change in speed of the rotor, the liquid within the compartment 5 tends to continue to rotate at its previous speed; thus, upon differential speed between the liquid in the compartment and of the compartment walls, turbulence, and hence good mixing is obtained.

The rotor is then completely braked to a very slow speed or to stop entirely. The central portion of the container 3 then will fill again with treatment liquid from the bottle 37. Upon re-starting of the centrifuge, liquid cannot flow into the compartment 5, however, since this compartment is already full. Sedimentation of the red blood corpuscles from the washing liquid is obtained by centrifugal force; the rotor 20 is accelerated to a very high speed. This also causes opening of the valve pin 29 — operated by centrifugal force for example by a centrifugal weight, now shown — by upward movement of the pin 29. Upon termination of sedimentation, pump unit 50 is energized — while the rotor continues to rotate — and pressurized fluid is introduced in the chamber 47 beneath the membrane 18. The compressed fluid acts on the membrane 18 to compress the lower foil 1 towards the upper foil 2. Additionally, the fluid acts on the valve pin 43 which is exposed thereto in the region of the slip seal 53 to close the duct 41 by upward movement of pin 43 so that back-flow of fluid from compartment 5 into the central compartment 3 is inhibited. By compression of membrane 18, liquid is pumped through the duct 32, the central duct 42, around form body 8, and through the open valve 29 and duct 30 into the compartment 6. A photoelectric sensor 55, 56 senses the transparency of color composition of the fluid flowing through duct 30 to compartment 6. The washing liquid is essentially colorless and transparent; as soon as red blood corpuscles appear, rather than the colorless washing liquid, pump 51 for the fluid pressure is disconnected. This opens valve 43, and additional, fresh washing liquid can flow from the container 3 through duct 41 into compartment 5 to again fill compartment 5. This also displaces the fluid in the chamber 47 beneath the lower foil 1.

The centrifuge is then again intermittently accelerated and braked, to further mix the new washing liquid with the already pre-washed blood in compartment 5, and the cycle is then repeated.

Upon termination of the treatment, that is, of washing of the blood, and to transport red blood corpuscles into the bag 34, infusion bottle 37 is first removed (with the rotor stopped) and the folded bag 34 (and, if present, also bag 33) are removed from chamber 36. The clamp 44 is then removed and the compressed fluid system 50 is again operated. This places pressure in chamber 47 beneath the lower foil 1 of compartment 5. Duct 41 is closed by the valve pin 43 (operated, also, by the pump unit 50, as before). Valve pin 43 engages the lower side of foil 1. The washed red blood corpuscles are now hydraulically transported by compression of membrane 18 through the duct 32 and valve 31 into bag 34. The valve pin 29 is closed (the rotor is stopped) and thus the red blood corpuscles cannot bypass into compartment 6.

The present invention, therefore, essentially provides the combination of a closed container for biological liquids which consists of flexible, foldable material having a plurality of compartments, located in the rotor of a centrifuge, and hydraulically operable. The method, in accordance with the present invention, permits operation of such a centrifuge with such containers to wash blood by using customary commercial blood bags and infusion bottles.

Various changes and modifications may be made within the scope of the invention concept. The rotor need not be formed or shaped with the compartments, as shown. The present invention is equally applicable to a rotor providing an essentially cylindrical centrifuging chamber, in which inserts are placed having the general cross-sectional shape indicated in FIG. 1, thus forming the chambers into which the container B can be placed. This container, as well as other bottles, bags, and the like, of various construction and shape may be used. In a preferred form, the entire container B, together with the infusion bottle 37 and at least one of the bags 34, can be located in the rotor; the entire assembly then forms a closed unit which can be easily sterilized. Other containers, bags, or vessels may be used, if they have the corresponding chambers or compartments and attachment elements so that they can be matched or fitted to an available rotor.

Control or flow of fluid, as described, can be done automatically by means of photo cells 55, 56 responsive to optical characteristics of the fluid flowing in duct 30, such as color or transparency. This arrangement may provide a light source 55, such as a light-emitting diode, and a photo-sensitive cell 56, electrically connected by slip rings (not shown) to control relays or the like. To provide for improved reception of optical signals, the form or profile body 8 can be made reflective at least in the region beneath light source 55. Other controls may be used, and with suitable arrangement, a ring-shaped window can be formed in the cover of the centrifuge for observation. Likewise, the deflection of the membrane 18 can be electromagnetically controlled.

The bag B preferably is a unitary element made of flexible biologically chemically insert plastic material which can be easily sterilized; it may, however, also be built up of an assembly of separate bags of similar plastic material, fitting into suitable chambers in the rotor, or in an adaptor located in the rotor itself. For simplicity of illustration, FIG. 1 illustrates the rotor as a unit directly formed with the chambers to fit a unitary bag B.

The bag B can be so constructed that one of the foils or films forming a wall thereof, for example the lower film 1, is reinforced at selected portions, for example beneath the compartment 5, to directly form the membrane. Conversely, portions of the bag structure may be made of thinner material to permit ready penetration thereof by a hypodermic needle. The body 8 is so constructed that it, together with the adjacent region of the walls forming the bag, provides the closable ducts or channels 30, 41, for example, which provides for fluid communication between the various compartments 3, 5, 6. Bottom 4 of compartment 3 of bag B may be reinforced.

We claim:

1. Bag for use in centrifugal treatment of biological liquids, for insertion into the rotor of a centrifuge having concentrically located chambers, comprising an essentially circular structure formed in a plurality of concentrically located compartments (3, 5, 6), each fitting into a respective chamber of the rotor (20) of the centrifuge, made of chemically inert, flexible collapsible plastic material, said compartments forming a central compartment (3), a first surrouding intermediate ring-shaped compartment (5) and an outer compartment (6) concentrically and ring-like surrounding the intermediate compartment (5);

communicating duct means (30, 41) hydraulically connecting said compartments;

and a dimensionally stable body (8) of chemically inert plastic material within said bag in essentially disk-shaped form, with an intermediate bulge, secured to the upper and lower walls of the bag at selected locations and leaving free spaces between the bag and said body, at least some of said free spaces forming said communicating ducts (30, 41).

2. Bag according to claim 1, wherein the central compartment (3) is essentially cylindrical.

3. Bag according to claim 1, wherein at least a portion of the wall of the bag defining one of said compartments is reinforced with respect to the remainder of the material of the bag to form a membrane element against the outside of which a pressure fluid can be applied for collapse of the bag.

4. Bag according to claim 1, wherein said body (8) is formed with perforations (13, 14) to form flow control means controlling fluid flow between said compartments of said bag when the flexible walls of the bag lie against the portions of said body (8) surrounding said perforations.

5. Bag according to claim 1, wherein said bag comprises two foil elements the dimensionally stable body being sandwiched between said foil elements, said foil elements being secured to each other along an inner circumferential ring, and an outer ring concentric with said inner ring, to define, interiorly of said inner ring, said central compartment (3), between said rings said intermediate compartment (5) and exteriorly of said outer ring said outer compartment (6), said foils being secured together at the outer edges to close said outer compartments, said body (8) being secured at selected positions to the upper and lower ones of said foils to form said connecting ducts (30, 41) at free locations between said body and the adjacent foil.

6. Bag according to claim 1, wherein the bulge in said body is ring-shaped and extends axially to bow out said intermediate compartment (5).

* * * * *